US010894647B2

(12) United States Patent
Burattini

(10) Patent No.: US 10,894,647 B2
(45) Date of Patent: Jan. 19, 2021

(54) BREAK-OPEN SINGLE-DOSE SEALED PACKAGE WITH A DOUBLE COMPARTMENT AND METHOD FOR THE PRODUCTION THEREOF

(71) Applicant: Easysnap Technology S.r.l., Modena (IT)

(72) Inventor: Christian Burattini, San Giovanni in Persiceto (IT)

( * ) Notice: Subject to any disclaimer, the term of this patent is extended or adjusted under 35 U.S.C. 154(b) by 0 days.

(21) Appl. No.: 16/477,147

(22) PCT Filed: Jan. 12, 2018

(86) PCT No.: PCT/IB2018/050206
§ 371 (c)(1),
(2) Date: Jul. 10, 2019

(87) PCT Pub. No.: WO2018/130984
PCT Pub. Date: Jul. 19, 2018

(65) Prior Publication Data

US 2019/0352070 A1 Nov. 21, 2019

(30) Foreign Application Priority Data

Jan. 12, 2017 (IT) ..... 102017000002877

(51) Int. Cl.
*B65D 75/32* (2006.01)
*B65D 75/58* (2006.01)
*B65D 81/32* (2006.01)

(52) U.S. Cl.
CPC ..... *B65D 75/327* (2013.01); *B65D 75/585* (2013.01); *B65D 75/5822* (2013.01);
(Continued)

(58) Field of Classification Search
CPC ..... B65D 33/16; B65D 75/32; B65D 75/327; B65D 75/58; B65D 75/5822;
(Continued)

(56) References Cited

U.S. PATENT DOCUMENTS 3,163,288 A * 12/1964 Arvidsson ..... A61B 17/06133 206/63.3
3,521,805 A 7/1970 Ward
(Continued)

FOREIGN PATENT DOCUMENTS

JP 2007209705 A * 8/2007 ..... B65D 81/32
WO WO-2009115667 A1 * 9/2009 ..... B65B 9/20
WO WO-2016093046 A1 * 6/2016 ..... B65D 81/32

OTHER PUBLICATIONS

PCT International Search Report and Written Opinion for PCT/IB2018/050206 dated Apr. 3, 2018.

*Primary Examiner* — Bryon P Gehman
(74) *Attorney, Agent, or Firm* — McCarter & English, LLP

(57) ABSTRACT

A break-open single-dose sealed package and method for the production thereof; the sealed package has: a first sheet of semi-rigid plastic material; a second sheet of flexible plastic material set on top of and welded to the first sheet along an annular weld, so as to define a sealed pocket containing a dose of a product; and a pre-weakened area that develops transversely and is obtained in a central area of the first sheet; the pocket is divided into two distinct and separated chambers which are insulated from one another and each contain a corresponding component of the product; and the pocket is divided into the two chambers due to a central weld connecting the second sheet to the first sheet and is weak, so as to be broken by exerting pressure on at least one of the two chambers.

13 Claims, 6 Drawing Sheets

(52) U.S. Cl.
CPC .. *B65D 81/3266* (2013.01); *B65D 2575/3236* (2013.01); *B65D 2575/3281* (2013.01)

(58) Field of Classification Search
CPC .. B65D 75/585; B65D 81/32; B65D 81/3266; B65D 83/00; B65D 83/04; B65D 2575/3236; B65D 2575/3281
USPC ..... 206/219, 484
See application file for complete search history.

(56) References Cited

U.S. PATENT DOCUMENTS

| | | | | |
|---|---|---|---|---|
| 3,608,709 | A * | 9/1971 | Pike | B29C 65/76 206/219 |
| 4,762,230 | A | 8/1988 | Croce | |
| 4,790,429 | A * | 12/1988 | Fukushima | B65D 81/3294 206/219 |
| 8,381,903 | B2 * | 2/2013 | Ilfrey | B65D 81/3266 206/219 |
| 9,169,052 | B2 * | 10/2015 | Bowers | B65D 75/32 |
| 9,174,881 | B2 * | 11/2015 | Cimaglio | B65D 81/3266 |
| 9,216,850 | B2 * | 12/2015 | Bowers | B65D 75/327 |
| 2010/0272868 | A1 * | 10/2010 | Krysty | B65D 81/3266 426/120 |
| 2011/0100859 | A1 * | 5/2011 | Burattini | B31F 1/08 206/524.6 |
| 2011/0170938 | A1 | 7/2011 | Littig et al. | |
| 2012/0196041 | A1 * | 8/2012 | Ilfrey | B65D 75/5855 206/222 |
| 2014/0231296 | A1 * | 8/2014 | Reggio | B65D 75/30 206/484 |

* cited by examiner

BREAK-OPEN SINGLE-DOSE SEALED PACKAGE WITH A DOUBLE COMPARTMENT AND METHOD FOR THE PRODUCTION THEREOF

CROSS-REFERENCE TO RELATED APPLICATIONS

This application is a 35 U.S.C. § 371 National Stage filing of International Application No. PCT/IB2018/050206, filed on Jan. 12, 2018, which claims priority to Italian Patent Application 102017000002877, filed on Jan. 12, 2017.

TECHNICAL FIELD

The present invention relates to a break-open single-dose sealed package and to a method for the production thereof.

PRIOR ART

The patent application WO2009040629A2 describes a break-open single-dose sealed package; the sealed package comprises a sheet of semi-rigid plastic material and a sheet of flexible plastic material, which is set on top of and welded to the sheet of semi-rigid plastic material, so as to define a sealed pocket which contains a dose of a fluid product. The sheet of semi-rigid plastic material has, at the centre, a pre-weakened area which guides a controlled breaking of the sheet of semi-rigid plastic material in order to cause the formation of an outlet opening for the product through the sheet of semi-rigid plastic material. In other words, in use to open the sealed package, a user must grip the sealed package with the fingers of one hand and fold the sealed package in a "V"-shape until the sheet of semi-rigid plastic material breaks in the pre-weakened area. The pre-weakened area comprises an inner incision which is obtained through an inner surface (i.e. facing towards the pocket) of the sheet of semi-rigid plastic material and an outer incision which is obtained through an outer surface of the sheet of semi-rigid plastic material and is aligned with inner incision.

However, the single-dose sealed package described in patent application WO2009040629A2 is not adapted to contain products consisting in the mixing of two components which until the last moment, that is, until the actual use of the product, must remain separate from one another. For example, in the pharmaceutical or cosmetic field the use of unstable mixtures is known, whose components must remain separate until the moment of actual use.

Patent applications U.S. Pat. No. 3,521,805A, US2011170938A1 and U.S. Pat. No. 4,790,429A describe a sealed package provided with a sealed pocket which, due to a central weld, is divided into two distinct and separate chambers which are insulated from one another and each contain a corresponding component of a product; in this sealed package it is necessary to create two distinct outlet openings (one for each chamber), so as to obtain the out-flow of both components from the sealed pocket, which can then be mixed outside of the sealed pocket. However, the mixing of the two components outside the sealed pocket is complicated (that is, impractical), unhygienic and hardly of excellent quality (that is, it is very unlikely that the two components can be well mixed outside the sealed pocket).

DESCRIPTION OF THE INVENTION

The object of the present invention is to provide a break-open single-dose sealed package and a method for the production thereof, which package and production method are free from the drawbacks described above and are, in particular, easy and inexpensive to implement.

According to the present invention, a break-open single-dose sealed package and a method for the production thereof are provided, according to what is stated in the attached claims.

BRIEF DESCRIPTION OF THE DRAWINGS

The present invention will now be described with reference to the attached drawings, which illustrate some non-limiting embodiments thereof, wherein.

PREFERRED EMBODIMENTS OF THE INVENTION

Figure 2:
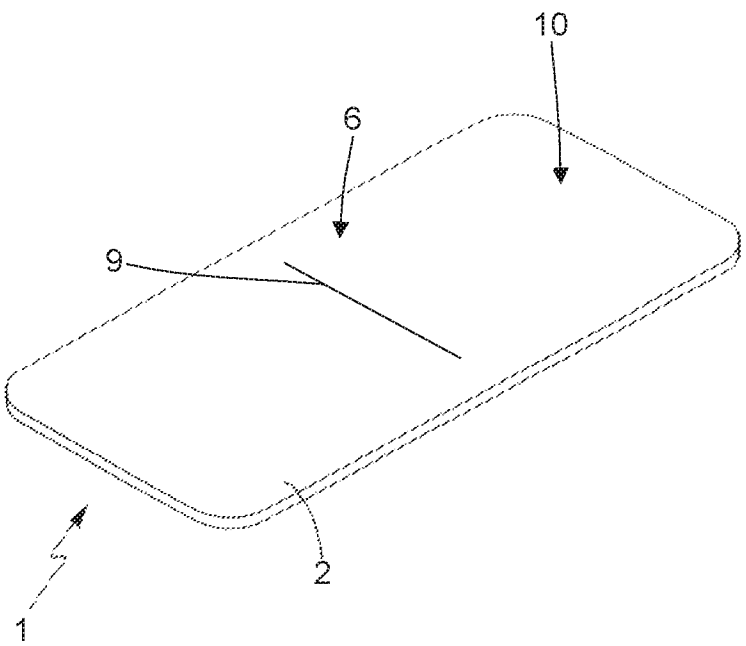
FIG. 2 is a bottom perspective view of the sealed package of FIG. 1.
Figure 1:
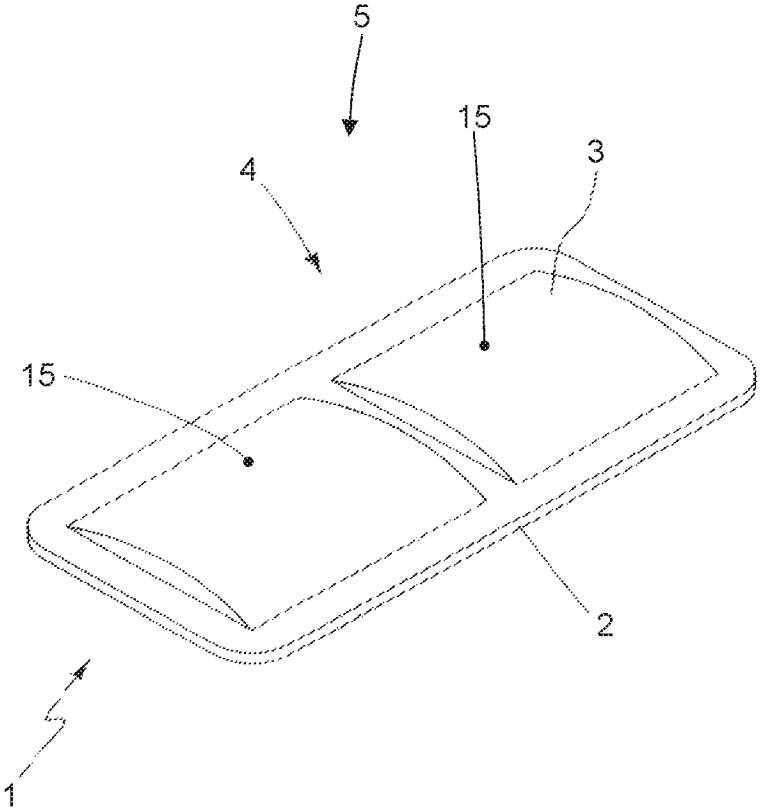
FIG. 1 is a top perspective view of a break-open single-dose sealed package made according to the present invention.

In FIGS. 1 and 2, number 1 denotes as a whole a break-open single-dose sealed package. The single-dose sealed package 1 has, in plan, a rectangular shape (that is, provided with two larger sides parallel one to the other and two smaller sides parallel one to the other) and comprises a sheet 2 of semi-rigid plastic material having a rectangular shape and a sheet 3 of flexible plastic material having a rectangular shape, which is set on top of and welded to the sheet 2 of semi-rigid plastic material, so as to define a sealed pocket 4 which contains a dose of a fluid product 5.

The sheet 2 of semi-rigid plastic material has, in the centre, a pre-weakened area 6, which is obtained in a central area of the sheet 2 of semi-rigid plastic material (in particular in a longitudinally centred area), which transversely develops (i.e. parallel to the smaller sides of the sealed package 1 and perpendicular to the larger sides of the sealed package 1), and guides a controlled breaking of the sheet 2 of semi-rigid plastic material in order to cause the formation of an outlet opening for the product 5 through the sheet 2 of semi-rigid plastic material. In other words, in use, to open the single-dose sealed package 1 a user must grip the single-dose sealed package 1 with the fingers of one hand and fold the single-dose sealed package 1 in a "V"-shape until the sheet 2 of semi-rigid plastic material breaks in the pre-weakened area 6. By breaking the sheet 2 of semi-rigid plastic material in the pre-weakened area 6, the product 5 can exit the single-dose sealed package 1 in a simple and hygienic manner.

Figure 3:
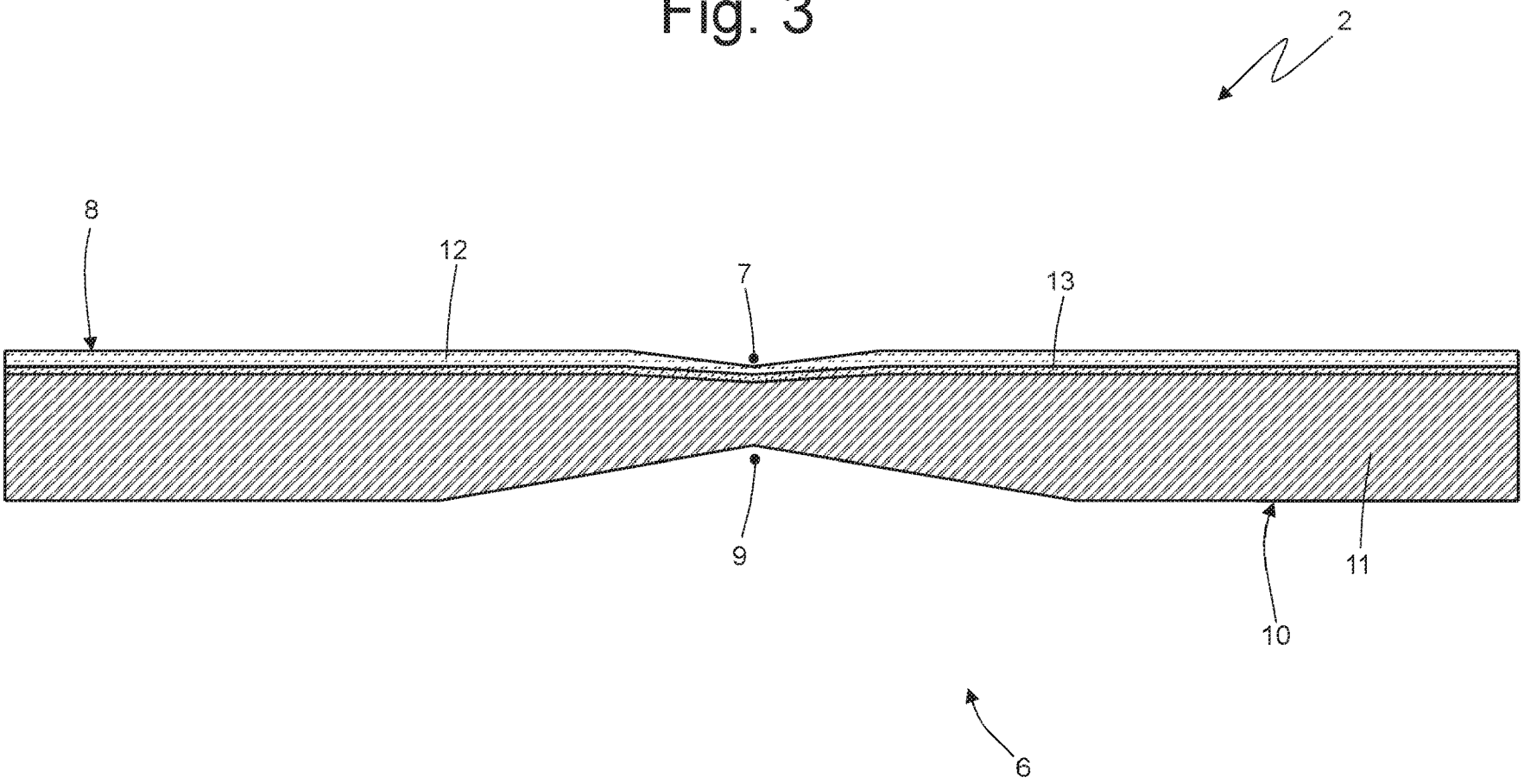
FIG. 3 is a schematic view in cross-section and at a pre-weakened area of the sealed package of FIG. 1.

As illustrated in FIG. 3, the pre-weakened area 6 comprises an inner incision 7 which is transversely oriented (i.e. parallel to the smaller sides of the single-dose sealed package 1 and perpendicular to the larger sides of the single-dose sealed package) and is obtained through an inner surface (i.e. facing towards the pocket 4) of the sheet 2 of semi-rigid plastic material and an outer incision 9 which is transversely oriented and is obtained through an outer surface 10 (i.e. opposite the pocket 4) of the sheet 2 of semi-rigid plastic material. In the preferred (but not limiting) embodiment illustrated in FIG. 3, the outer incision 9 is transversely and longitudinally aligned with respect to the inner incision 7, i.e. the outer incision 9 perfectly overlaps the inner incision 7.

According to the embodiment illustrated in FIG. 3, the sheet 2 of semi-rigid plastic material is formed by a laminate made by a supporting layer 11 arranged on the outer part (i.e. on the side opposite the pocket 4) and a heat-sealable layer 12 arranged on the inner part (i.e. on the same side of the pocket 4 and in contact with sheet 3 of flexible plastic material). Between the supporting layer 11 and the heat-sealable layer 12 a further insulating or barrier layer 13 is provided having the purpose of ensuring non-permeability to air and/or light. By way of non-limiting example, the sheet 2 of semi-rigid plastic material could be made by a white polystyrene (PS) supporting layer 11 having a thickness of 400 microns (±10%), by a "Evoh" or aluminium barrier layer 13 having a thickness of 7 microns (±10%), and by a heat-sealable layer of polyethylene (PE) having a thickness of 43 microns (±10%).

The outer incision 9 is formed in the outer wall 10 of the sheet 2 of semi-rigid plastic material and is obtained by locally deforming the sheet 2 of semi-rigid plastic material and in particular the supporting layer 7 of the sheet 2 of semi-rigid plastic material.

The inner incision 7 is obtained in the inner wall 8 of the sheet 2 of semi-rigid plastic material, which has a "V" shape and is made by locally deforming the sheet 2 of semi-rigid plastic material and in particular all three layers, supporting 11, heat-sealable 12 and barrier 13, of the sheet 2 of semi-rigid plastic material. It is important to note that at the inner incision 7 the heat-sealable layer 12 and above all the barrier layer 13 of the sheet 2 of semi-rigid plastic material are locally deformed (even in an irregular manner), but are not torn, i.e. they maintain their integrity. Due to the substantial integrity of the barrier layer 13 of the sheet 2 of semi-rigid plastic material also at the inner incision 7 formed in the inner wall 8 of the sheet 2 of semi-rigid plastic material it is possible to ensure perfect insulation of the pocket 4 which is therefore adapted to also contain perishable and/or controlled bacterial count products such as foods, medicines or cosmetics. Obviously, during the break-opening of the single-dose sealed package 1 obtained by folding the single-dose sealed package in a "V" shape, it is necessary to break, at the pre-weakened area 6, all three layers, supporting 11, heat-sealable 12 and barrier 13, of the sheet 2 of semi-rigid plastic material.

Figure 5:
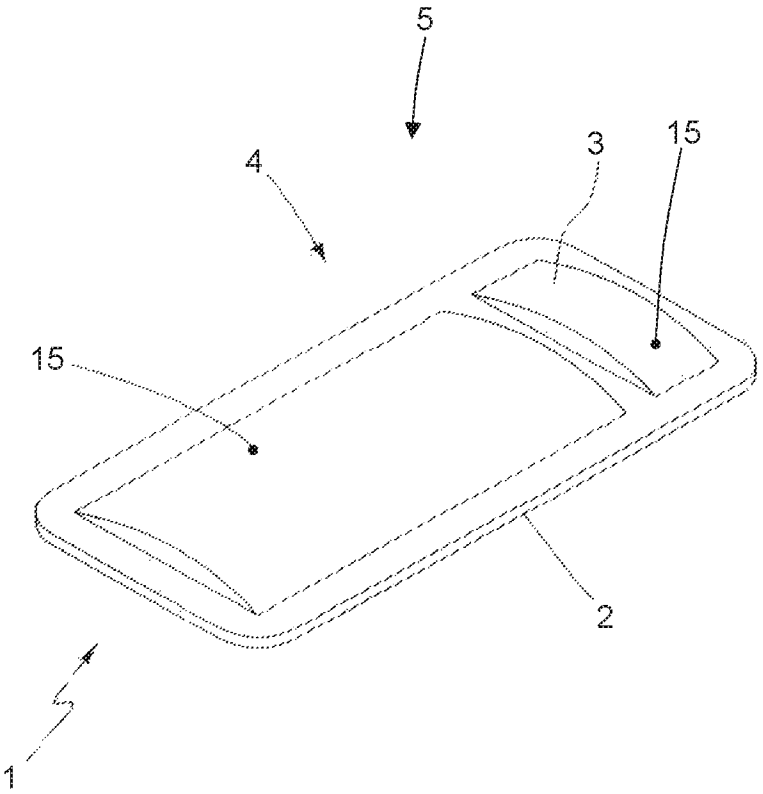
FIG. 5 is a top perspective view of an alternative package of FIG. 1.

In the (non-limiting) embodiment illustrated in FIG. 3, the inner incision 7 has a variable depth transversely and along its length; said feature is preferable (but not strictly necessary) to improve the opening of the single-dose sealed package 1 when the single-dose sealed package 1 is folded in a "V" shape (as illustrated in FIG. 5). In other words, the fact that the inner incision 7 has transversely and along its length a variable depth allows to obtain a progressive breaking of the sheet 2 of semi-rigid plastic material when the single-dose sealed package 1 is folded in a "V" shape (as illustrated in FIG. 5). In the (non-limiting) embodiment illustrated in FIG. 3, the outer incision 9 has a variable depth transversely and along its length; said feature is not strictly necessary, since the outer incision 9 could have a constant depth transversely and along its length. In the embodiment illustrated in FIG. 3, both incisions 7 and 9 have a "V" shape in cross-section and therefore have the maximum depth in the centre part; according to other embodiments not illustrated, the incisions 7 and 9 could have, in cross-section, different shapes from the "V" shape.

Figure 4:
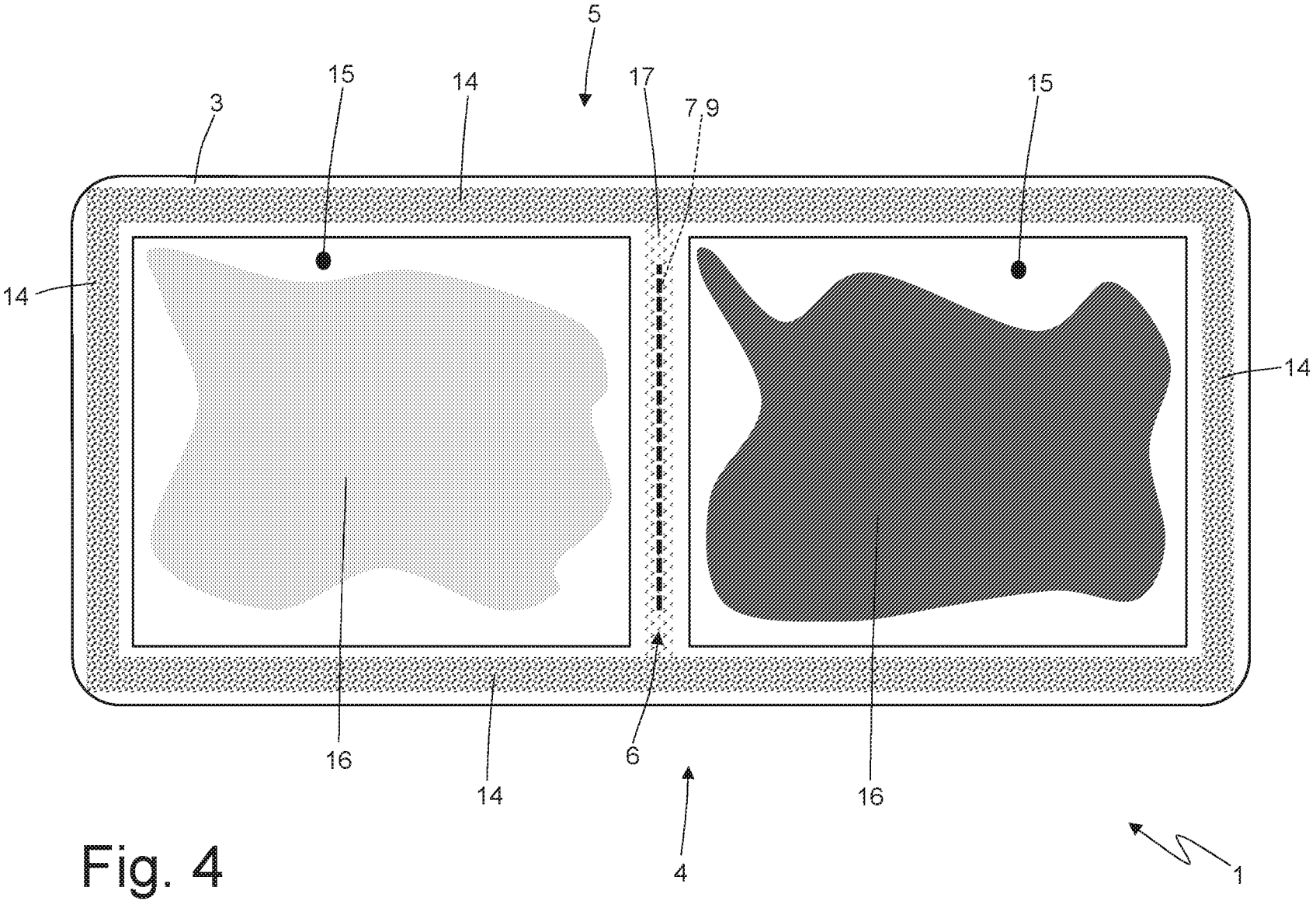
FIG. 4 is a schematic view and from the top of the package of FIG. 1.

According to what is better illustrated in FIG. 4, the pocket 4 is defined by an annular weld 14 which runs along the outer edge of the sheets 2 and 3 and connects the two sheets 2 and 3 in a stable and permanent manner. The pocket 4 is divided into two distinct and separate chambers 15 which are insulated from one another and each contain a corresponding component 16 of the product 5; in other words, the product 5 is formed by the mixing of two components 16 which, until the last moment, that is, until the actual use of the product 5, must remain separate one from the other (the product 5 is an unstable mixture which rapidly degrades and therefore the two components 16 must be mixed only when the product 5 is actually used). The pocket 4 is divided into the two chambers 15 by effect of a central weld 17 which connects the sheet 3 of flexible plastic material to the sheet 2 of semi-rigid plastic material and is weak, so as to be broken by exerting a pressure on at least one of the two chambers 15. In particular, the central weld 17 which separates the two chambers 15 connects two opposite areas of the annular weld 14 to one another, which defines the pocket 4.

In use, before folding the single-dose sealed package 1 in a "V" shape, until the sheet 2 of semi-rigid plastic material is broken at the pre-weakened area 6, the user presses (compresses) at least one of the two chambers 15 to generate inside the chamber 15, a pressure which is well below the resistance of the annular weld 14, but is higher than the resistance of the central weld 17 and therefore causes the break of the central weld 17; when the central weld 17 breaks, the two chambers 15 enter into mutual communication allowing the mixing of the two components 16 (inside the pocket 4 still being completely intact on the outside) and therefore the formation of the final product 5 (inside of the pocket 4 still being completely intact on the outside) immediately before its actual use.

According to a preferred embodiment, the annular weld 14 defining the pocket 4 is made by heating the two sheets 2 and 3 at a first welding temperature whereas the central weld 17 separating the two chambers 15 is made by heating the two sheets 2 and 3 at a second welding temperature lower (by some tens of Celsius degrees) than the first welding temperature. In other words, the different mechanical resistance of the two welds 14 and 17 is obtained by differentiating the corresponding welding temperatures.

In the embodiment illustrated in FIGS. 1-4, the pre-weakened area 6 (formed by the two incisions 7 and 9) overlaps the central weld 17 separating the two chambers 15 and therefore the pre-weakened area 6 is arranged between the two chambers 15. In this embodiment, by folding the single-dose sealed package 1 in a "V" shape until the sheet 2 of semi-rigid plastic material breaks in the pre-weakened area 6, no leaking occurs if the first central weld 17 has not been broken.

Figure 6:
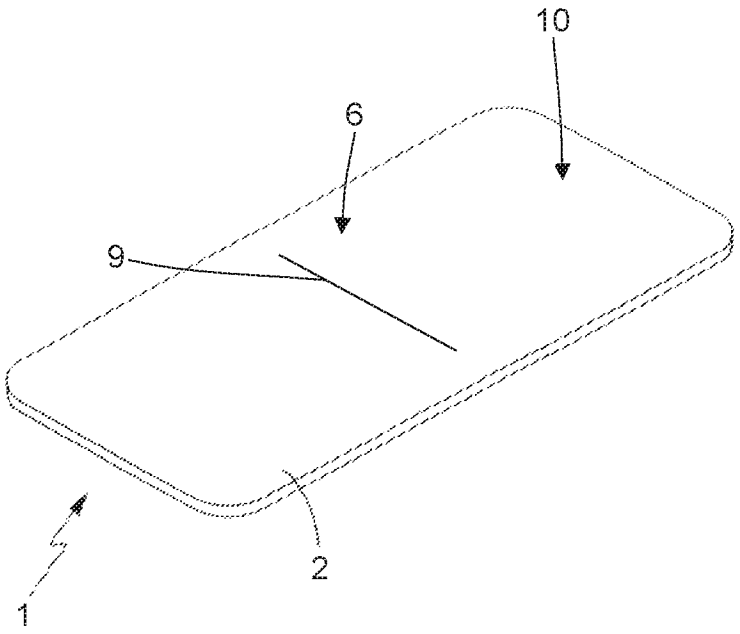
FIG. 6 is a bottom perspective view of the sealed package of FIG. 5.

In the alternative embodiment illustrated in FIGS. 5 and 6, the pre-weakened area 6 (formed by the two incisions 7 and 9) is separate from and arranged beside the central weld 17 separating the two chambers 15 and therefore the pre-weakened area 6 is arranged at one of the two chambers 15. In this embodiment, by folding the single-dose sealed package 1 in a "V" shape until the sheet 2 of semi-rigid plastic material breaks in the pre-weakened area 6, the out-flow of a single component 16 is obtained if the central weld 17 has not been previously broken.

According to a possible embodiment, the central weld 17 that separates the two chambers 15 is made before the annular weld defining the pocket 4; in other words, when the annular weld 14 defining the pocket 4 is made, the central weld 17 that separates the two chambers 15 is already present (that is, already previously done).

Figure 7:
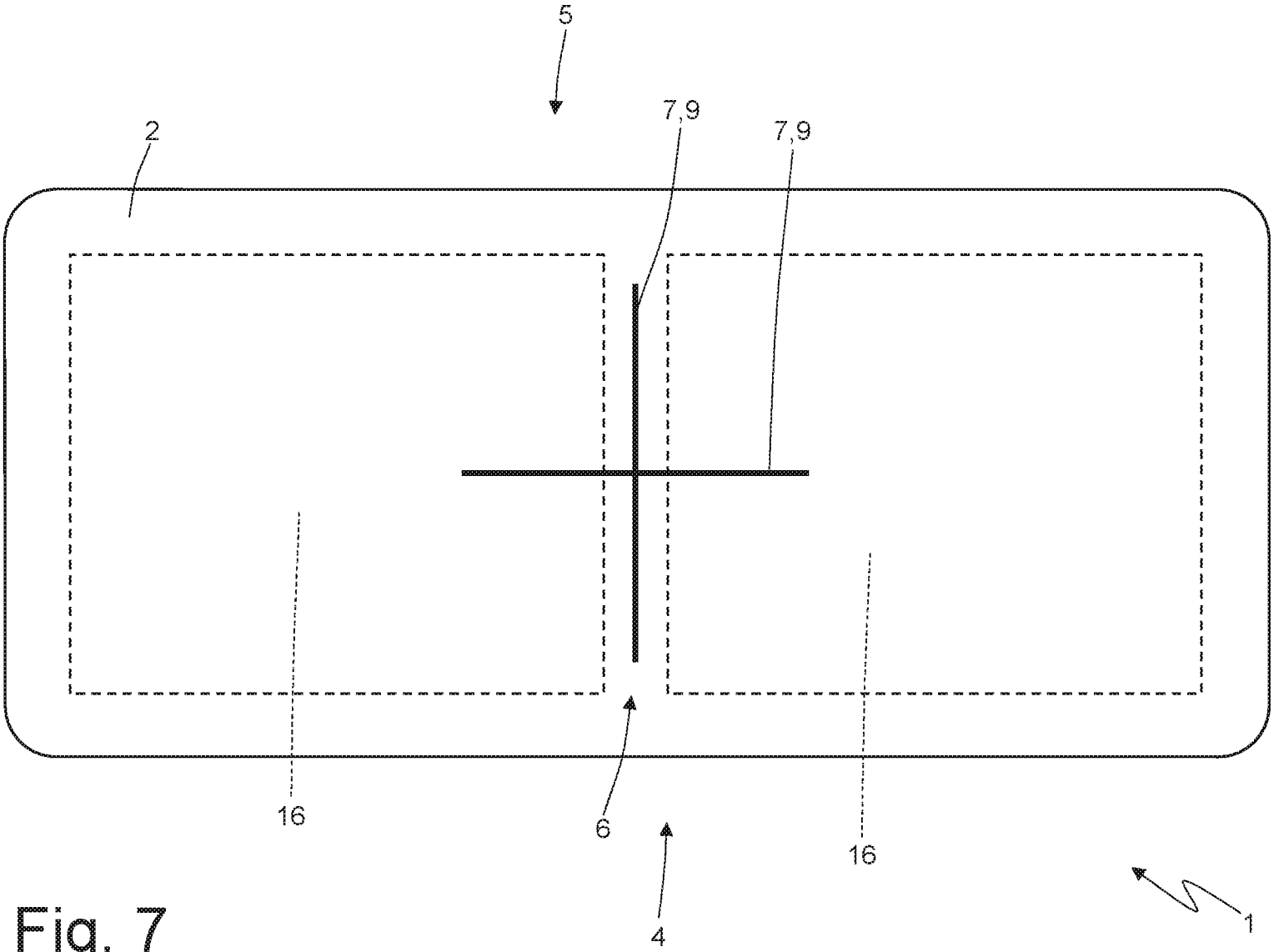
FIG. 7 is a view from the bottom of an alternative of the package of FIG. 1.
Figure 8:
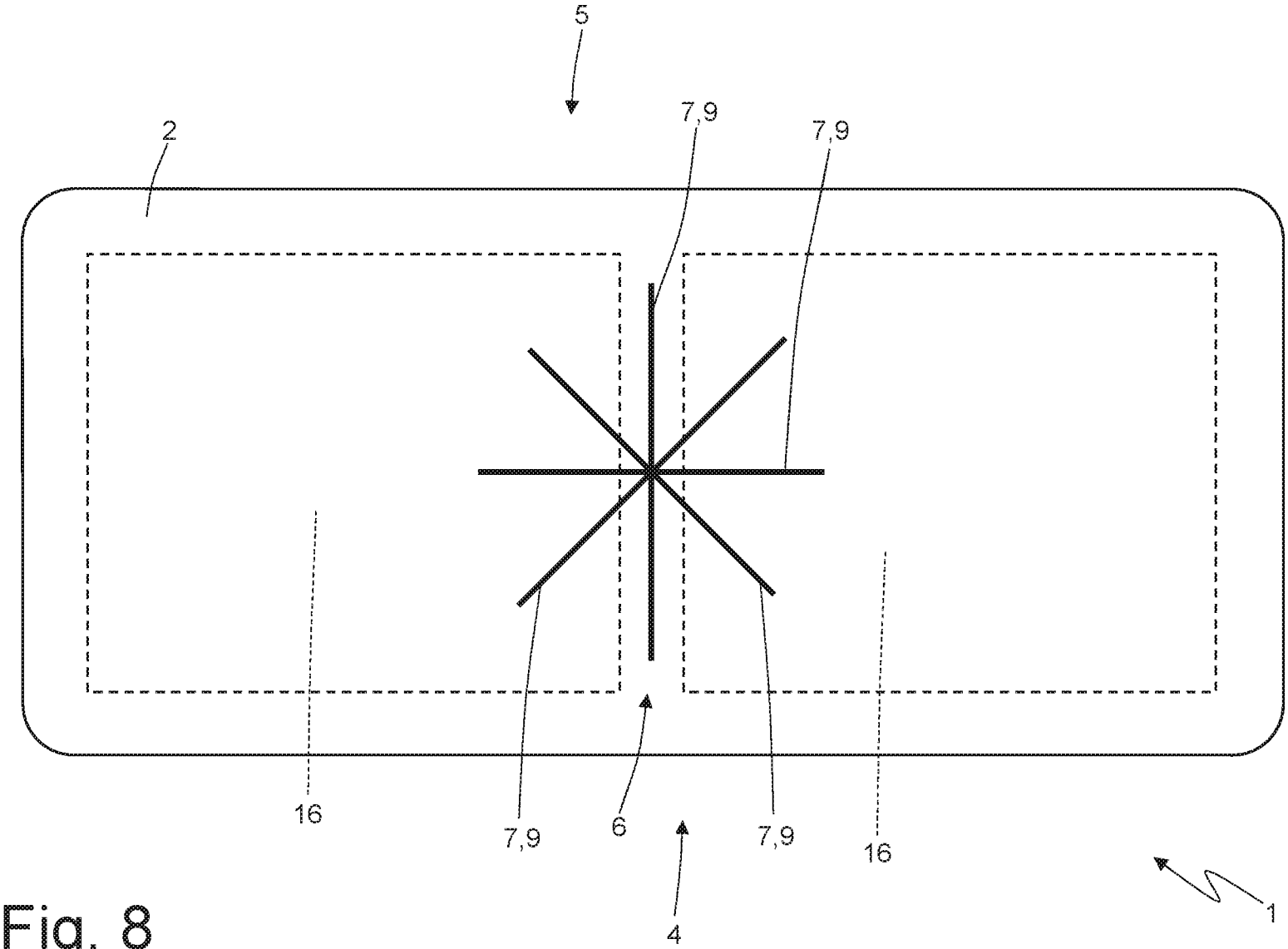
FIG. 8 is a view from the bottom of a further alternative of the package of FIG. 1.

In the embodiments illustrated in FIGS. 1-6, the pre-weakened area 6 develops only transversely (i.e. parallel to the smaller sides of the single-dose sealed package 1 and perpendicular to the larger sides of the single-dose sealed package 1); consequently, the two incisions 7 and 9 (inner incision 7 and outer incision 9 perfectly overlapping one another) are transversely oriented (i.e. parallel to the smaller sides of the single-dose sealed package 1 and perpendicular to the larger sides of the single-dose sealed package 1). In the alternative embodiments illustrated in FIGS. 7 and 8, the pre-weakened area 6 develops both transversely (i.e. parallel to the smaller sides of the single-dose sealed package 1 and perpendicular to the larger sides of the single-dose sealed package 1) and longitudinally (i.e. perpendicular to the smaller sides of the single-dose sealed package 1 and parallel to the larger sides of the single-dose sealed package 1); consequently, in the embodiment illustrated in FIG. 7, two transversely oriented incisions 7 and 9 are provided (inner incision 7 and outer incision 9 which perfectly overlap one another) and two longitudinally oriented incisions 7 and 9 (inner incision 7 and outer incision 9 which perfectly overlap one another) and in the embodiment illustrated in FIG. 8, further obliquely orientated incisions 7 and 9 are also added.

The presence of incisions 7 and 9 having a longitudinal extension also makes it possible to increase the size of the opening which opens through the sheet 2 of semi-rigid plastic material in the pre-weakened area 6 when the single-dose sealed package 1 is folded in a "V" shape, allowing the final product 5, obtained by mixing (inside the pocket 4 which is still completely intact on the outside) to be delivered more rapidly to the two components 16.

The single-dose sealed package 1 described above has numerous advantages.

Firstly, the single-dose sealed package 1 described above allows to contain products 5 formed by the mixing of two components 16 which, until the last moment, that is, until the actual use of the product 5, must remain separate one from the other.

Moreover, the single-dose sealed package 1 described above does not present any penalization to the functionality with respect to a similar known single-dose sealed package, since the breaking of the central weld 17, to determine the mixing of the two components 16, is easy, fast and intuitive. In particular, the mixing of the two components 16 takes place completely inside the pocket 4 still completely intact towards the outside, therefore the mixing of the two components 16 is practical, hygienic and allows to easily obtain an optimal mixing.

Finally, the single-dose sealed package 1 described above is simple and inexpensive to manufacture because the manufacturing thereof is completely analogous to the manufacturing of a similar standard single-dose sealed package; that is, the single-dose sealed package 1 described above can be made by adding a simple central welding device to an existing packaging machine which produces standard sealed packages.

The invention claimed is:

1. A break-open single-dose sealed package (1); the sealed package (1) comprising:

a first sheet (2) of semi-rigid plastic material;

a second sheet (3) of flexible plastic material set on top of and welded to the first sheet (2) along an annular weld (14), so as to define a sealed pocket (4) which contains a dose of a product (5); and a pre-weakened area (6), which is obtained in a central area of the first sheet (2), so as to guide, following a folding of the sealed package (1), a controlled breaking of the first sheet (2) in the pre-weakened area (6), in order to cause the formation of an outlet opening for the product (5) through the first sheet (2);

wherein the pocket (4), due to a central weld (17) connecting the second sheet (3) to the first sheet (2), is divided into two distinct and separate chambers (15), which are insulated from one another and each contain a corresponding component (16) of the product (5);

wherein the annular weld (14) that defines the pocket (4) has a greater mechanical resistance than the central weld (17) separating the two chambers (15); and wherein the central weld (17) dividing the pocket (4) into the two chambers (15) is weak, so as to be broken, without breaking the annular weld (14) as well, by exerting a pressure on at least one of the two chambers (15), so as to be able to mix the two components (16) of the product (5) one with the other before folding the sealed package (1) and therefore before determining a controlled breaking of the first sheet (2) in the pre-weakened area (6).

2. The single-dose sealed package (1) according to claim 1, wherein:

the annular weld (14) defining the pocket (4) is made by heating the two sheets (2, 3) at a first welding temperature; and the central weld (17) separating the two chambers (15) is made by heating the two sheets (2, 3) at a second welding temperature, which is lower than the first welding temperature.

3. The single-dose sealed package (1) according to claim 1, wherein the central weld (17) separating the two chambers (15) connects two opposite areas of the annular weld (14) to one another, which defines the pocket (4).

4. The single-dose sealed package (1) according to claim 1, wherein the pre-weakened area (6) overlaps the central weld (17) separating the two chambers (15) and, therefore the (6) pre-weakened area is arranged between the two chambers (15).

5. The single-dose sealed package (1) according to claim 4, wherein the pre-weakened area (6) is arranged outside both chambers (15).

6. The single-dose sealed package (1) according to claim 1, wherein the pre-weakened area (6) is separate from and arranged beside the central weld (17) separating the two chambers (15) and, therefore, the pre-weakened area (6) is arranged at one of the two chambers (15).

7. The sealed package (1) according to claim 1, wherein:

the single-dose sealed package (1) has a rectangular shape, in plan, with two larger sides parallel one to the other and two smaller sides parallel one to the other; and the pre-weakened area (6) develops only transversely, that is, parallel to the two smaller sides of the single-dose sealed package (1).

8. The sealed package (1) according to claim 1, wherein:

the single-dose sealed package (1) has a rectangular shape, in plan, provided with two larger sides parallel one to the other and two smaller sides parallel one to the other; and the pre-weakened area (6) develops both transversely, that is, parallel to the two smaller sides of the single-dose sealed package (1), and longitudinally, that is, parallel to the two larger sides of the single-dose sealed package (1).

9. The sealed package (1) as claimed in claim 8, wherein the pre-weakened area (6) comprises at least one incision (7, 9) arranged transversely, that is, parallel to the two smaller sides of the single-dose sealed package (1), and at least one incision (7, 9) arranged longitudinally, that is, parallel to the two larger sides of the single-dose sealed package (1).

10. The single-dose sealed package (1) according to claim 1, wherein:

the pre-weakened area (6) comprises an inner incision (7), which is obtained through an inner surface (8) of the first sheet (2) facing the pocket (4) and an outer incision (9), which is obtained through an outer surface (10) of the first sheet (2) opposite the pocket (4) and is aligned with the inner incision (7); and the outer incision (9) has a variable depth along its length, and/or the inner incision (7) has a variable depth along its length.

11. The single-dose sealed package (1) according to claim 1, wherein the central weld (17) separating the two chambers (15) is made before the annular weld (14) defining the pocket (4).

12. A method for the production of a break-open single-dose sealed package (1); the production method comprising the steps of:

setting on top of one another and welding along an annular weld (14) a first sheet (2) of semi-rigid plastic material and a second sheet (3) of flexible plastic material, so as to define a sealed pocket (4) containing a dose of a product (5);

manufacturing a pre-weakened area (6), which develops transversely in a central area of the first sheet (2), so as to guide, following a folding of the sealed package (1), a controlled breaking of the first sheet (2) in the pre-weakened area (6), in order to cause the formation of an outlet opening for the product (5) through the first sheet (2); and making a central weld (17), which connects the second sheet (3) to the first sheet (2) and divides the pocket (4) into two distinct and separate chambers (15), which are insulated from one another and each contain a corresponding component (16) of the product (5);

wherein the annular weld (14) defining the pocket (4) has a greater mechanical resistance than the central weld (17) separating the two chambers (15); and wherein the central weld (17) dividing the pocket (4) into the two chambers (15) is weak, so as to be broken, without breaking the annular weld (14) as well, by exerting a pressure on at least one of the two chambers (15), so as to be able to mix the two components (16) of the product (5) one with the other before folding the sealed package (1) and therefore before determining a controlled breaking of the first sheet (2) in the pre-weakened area (6).

13. The production method according to claim 12, wherein:

the annular weld (14) defining the pocket (4) is made by heating the two sheets (2, 3) at a first welding temperature; and the central weld (17) separating the two chambers (15) is made by heating the two sheets (2, 3) at a second welding temperature, which is lower than the first welding temperature.

* * * * *